US010384747B2

(12) United States Patent
Albrigtsen

(10) Patent No.: US 10,384,747 B2
(45) Date of Patent: Aug. 20, 2019

(54) SYSTEM AND METHOD FOR HANDLING LARGE AND HEAVY CONSTRUCTIONS FROM AN OFFSHORE INSTALLATION VESSEL

(71) Applicant: MacGregor Norway AS, Arendal (NO)

(72) Inventor: Rolf Albrigtsen, Grimstad (NO)

(73) Assignee: MacGregor Norway AS, Arendal (NO)

( * ) Notice: Subject to any disclaimer, the term of this patent is extended or adjusted under 35 U.S.C. 154(b) by 163 days.

(21) Appl. No.: 15/524,853

(22) PCT Filed: Nov. 6, 2015

(86) PCT No.: PCT/EP2015/075881

§ 371 (c)(1),
(2) Date: May 5, 2017

(87) PCT Pub. No.: WO2016/071482

PCT Pub. Date: May 12, 2016

(65) Prior Publication Data

US 2018/0334225 A1 Nov. 22, 2018

(30) Foreign Application Priority Data

Nov. 7, 2014 (NO) ..... 20141324

(51) Int. Cl.
*B63B 27/08* (2006.01)
*B63B 27/16* (2006.01)
*B63B 35/00* (2006.01)

(52) U.S. Cl.
CPC ..... *B63B 27/16* (2013.01); *B63B 27/08* (2013.01); *B63B 35/003* (2013.01); *B63B 2027/165* (2013.01)

(58) Field of Classification Search
CPC ..... B63B 27/16; B63B 35/003; B63B 27/08; B63B 2027/165
See application file for complete search history.

(56) References Cited

U.S. PATENT DOCUMENTS 3,987,638 A 10/1976 Burkhardt et al.
4,683,832 A * 8/1987 Dysarz ..... B63B 35/003 114/258

(Continued)

FOREIGN PATENT DOCUMENTS

WO 2004/022421 A1 3/2004
WO 2010/109243 A2 9/2010

OTHER PUBLICATIONS

International Search Report issued in corresponding application No. PCT/EP2015/075881 dated May 18, 2016 (3 pages).

(Continued)

*Primary Examiner* — Anthony D Wiest
(74) *Attorney, Agent, or Firm* — Osha Liang LLP

(57) ABSTRACT

A load handling system for submerging of load from a water surface to a position situated under a connected installation vessel. The system includes a submergible load support, which includes a ballast system, and a controllable pendulum system including a first rigid pendulum device, which includes a first end pivotably connected to the support and a second end connectable to the vessel in a first pivot joint, and a second rigid pendulum device, oriented parallel to the first device, which includes a first end pivotably connected to the support; and a second end connectable to the vessel in a second pivot joint, the first ends of the first and second devices are situated symmetrically around a centered vertical plane through the support in a direction parallel to the devices and in that the sizes and connecting positions of the pendulum system allow for controllable pendulum movement of the support.

21 Claims, 13 Drawing Sheets

(56) References Cited

U.S. PATENT DOCUMENTS

| | | | | |
|---|---|---|---|---|
| 4,829,924 | A * | 5/1989 | Dysarz | B63B 35/003 114/260 |
| 5,097,786 | A | 3/1992 | Sheffield | |
| 6,210,076 | B1 * | 4/2001 | Haney | B63B 9/065 114/242 |
| 6,327,992 | B1 | 12/2001 | Martin | |
| 6,923,598 | B2 * | 8/2005 | Vatsv.ang.g | B63B 35/003 405/203 |
| 2013/0291779 | A1 | 11/2013 | Clarke | |
| 2013/0340668 | A1 | 12/2013 | Robertson | |

OTHER PUBLICATIONS

Written Opinion of the International Searching Authority issued in corresponding application No. PCT/EP2015/075881 dated May 18, 2016 (6 pages).

Norwegian Search Report issued in corresponding application No. 20141324 dated Feb. 13, 2015 (2 pages).

International Preliminary Report on Patentability issued in corresponding application No. PCT/EP2015/075881 dated Oct. 18, 2016 (14 pages).

Sigve Håland, "Lowering and lifting operations through moonpools: Hydrodynamic investigations"; Norwegian University of Science and Technology, Department of Marine Technology; Jun. 2014 (98 pages).

* cited by examiner 1
11
2
10
10a
3'
10
3'
3'
3
8d
8f
10b
10
6c
4
6a
8c
1a
8e
8
8b
5
7
7'
8a
A
1
11
10b
8d
8c
1a
2
10
8f
10
10a
3'
8
8e
6
B
8a
6a
8b
1
11
10b
8d
8c
1a
5
8e
10
2
8f
10
10a
10a
3
8a
6a
8b
C 10
2
8e
8f
3
6c
8a
6
6a
8b
6c
D

A

B

A

B

SYSTEM AND METHOD FOR HANDLING LARGE AND HEAVY CONSTRUCTIONS FROM AN OFFSHORE INSTALLATION VESSEL

TECHNICAL FIELD

The present invention relates to a load handling system, an installation vessel for submerging loads to the seabed, and a method thereof.

BACKGROUND

In the latter years there have been an increasing need for being able to install large subsea constructions from installation vessels, see for instance http://fuelfix.com/blog/2014/05/06/statoil-pursuing-huge-subsea-factories/, http://www.statoil.com/no/technologyinnovation/fielddevelopment/aboutsubsea/Pages/GullfaksVaatgasskompression.aspx and http://www.offshoreenergytoday.com/douglas-westwood-117b-to-be-spent-on-subsea-systems-by-2018/.

For submerging of heavy constructions from installation vessel it is common to use the work well (i.e. moonpool) of the installation vessel since such solutions usually reduce the requirement of comprehensive weight balancing. An example of submerging of loads through a center well is described in the article «Lowering and lifting operations through moonpools: Hydrodynamic investigations» by Sigve Håland, Marine Technology, June 2014 (http://www.diva-portal.org/smash/get/diva2:742177/FULLTEXT01.pdf). An important criteria for using the work well of the vessel is among other things that the available lifting equipment has the required lifting capacity for accomplishing the submerging operation.

However, this solution requires that the cross-section of the center well is larger than the cross-section of the particular construction, and thus a need for larger vessels.

As an alternative to the submerging of loads through the center well of the vessel, the patent publication WO 2010/109243 discloses a solution, wherein the load to be submerged is arranged on an appropriate barge, and wherein the barge is guided horizontally below the installation vessel to a position being beneath the installation vessel by use of a tender vessel. The load is then raised from the barge by use of a dedicated crane and the barge is guided away by said tender vessel. Consequently, the load hangs below the installation vessel and is ready for submerging to the seabed. This known solution is considered to be very expensive since it requires the use of barges having at least two side columns of large dimensions, and use of a tender vessel, both for guiding the barge with the load to the installation area and for positioning the load below the vessel. In addition, the positioning of the barge will be vulnerable for environmental forces, such as subsea currents. Regarding other alternatives for submerging loads, patent publication U.S. Pat. No. 3,987,638 may be mentioned. This publication describes a system which submerges loads from the water line to a position below the installation vessel by use of buoyancy elements and lines. This system will also be vulnerable to environmental forces during operation. In addition, the positioning of the load will not be very predictable due to the significant movability of the lines.

Thus, it is a goal of one or more embodiments of the present invention to manufacture a load handling system which shows a high degree of stability during submerging of large and/or heavy loads to the seabed, even during harsh weather conditions, such as tall waves or strong currents, and which at the same time avoids expensive modifications of, and/or additions to, commercially available equipment. Another purpose of one or more embodiments of the present invention is to develop a system which can handle large and/or heavy loads through the work well of the vessel even when the minimal ground area of the work well is too small for allowing the relevant constructions/loads to be submerged therethrough.

SUMMARY

One or more embodiments of the present invention may include a load handling system according to claim 1, an installation vessel according to claim 14 which use the inventive load handling system and a method comprising the steps in claim 19, wherein the steps may be performed in any sequence. Further advantageous features are defined in the dependent claims.

In particular, one or more embodiments of the invention relate to a load handling system suitable for submerging of load from a water surface to a position situated below a connected installation vessel. The load handling system comprises a submergible load support for support of the load to be submerged, which submergible load support comprises a ballast system.

One or more embodiments of the invention are further characterized in that the handling system comprises a controllable pendulum system comprising a first rigid pendulum device and a second rigid pendulum device, wherein the second pendulum device is oriented parallel to the first pendulum device. The first rigid pendulum device comprises a first end which is pivotably connected to the submergible load support i a first fulcrum and a second end which is connectable to the installation vessel in a first pivot joint. Further, the second rigid pendulum device comprises a first end which is pivotably connected to the submergible load support in a second fulcrum and a second end which is connectable to the installation vessel in a second pivot joint. Note that in the present disclosure, rigid means that the pendulum device does not comprise one or more movable joints between the end points of the pendulum device. Since the first end of the first rigid pendulum device and since the first end of the second rigid pendulum device is symmetrically situated, or almost symmetrically, about a centered vertical plane through the load support in a direction parallel to the pendulum devices. The sizes and the connecting positions of the pendulum system allows a controllable pendulum movement of the load support between a first position situated at the water surface at the installation vessel and a second position situated below the installation vessel when the load handling system is pivotably connected to the vessel. The load handling system is further configured such that an initial orientation of the peripheral surfaces, relative to the water surface, of the load support and/or the deck plane of the vessel is kept constant, or close to constant, at least during said pendulum movement.

In an advantageous embodiment, the second position is situated in or close to a vertical axis going through the centre of gravity of the installation vessel.

In another advantageous embodiment, the second position is situated below a work well of the installation vessel, in or close to a centre axis of the work well.

In another advantageous embodiment, the load support comprises a barge which is suitable for support of loads.

In another advantageous embodiment, each of the pendulum devices comprises a dampening device, preferably spring dampening, which is suitable for dampening of forces established as a consequence of relative movement between the installation vessel and the load support.

In another advantageous embodiment, each of the pendulum devices comprises a pendulum arm having a telescopic shape, wherein the telescopic shape allows for controllable regulation of the length of the pendulum arm. Such a design allows for shortening the length(s), which allows a configuration wherein the arms are permanently mounted on the vessel, for example by use of suitable locking devices. The pivot joints/fulcrums may also have a limited degree of vectorial freedom for among other things to avoid that the moment (torque) in the support becomes too high. Spherical roller bearings or the like may be used.

In another advantageous embodiment, the first end of the first pendulum device and the first end of the second pendulum device are pivotably connected to a first peripheral surface and a second peripheral surface of the load support, respectively.

In another advantageous embodiment, the second end of the first rigid pendulum device and the second end of the second rigid pendulum device are, during use, situated symmetrical, or close to symmetrical, around a centered vertical plane through the installation vessel in a direction parallel to the pendulum devices.

In another advantageous embodiment each of the first and the second pendulum device comprises a first pendulum arm and a second pendulum arm, preferably arranged in parallel.

In another advantageous embodiment, the orientation of at least one of the at least one of the peripheral surfaces of the load support is held parallel, or close to parallel, to the water surface, at least during said pendulum movement, preferably also a certain time before the pendulum movement and to the load is lifted away from the load bearing surface of the load support.

In another advantageous embodiment, the system further comprises a lifting line comprising a first end which is connectable to the load, preferably with releasing possibility, and a second end which is connectable to a lift device arranged on the installation vessel, preferably with releasing possibility, and wherein the length of the lifting line is longer than the minimum distance from one or more connecting positions on the load, through a work well connected to the installation vessel, and to the lift device.

In another advantageous embodiment, the load handling system further comprises means for providing pendulum movement, in that the means for providing the pendulum movement is configured to activate the pendulum system such that the load support moves between the first position at the water surface at the installation vessel and a position below the installation vessel, preferably in or close to the centre of gravity of the vessel and/or below the work well/moonpool of the vessel. The means may comprise at least one pendulum winch being arrangeable on the installation vessel, for example as an integrated or movable drum in the stern of the vessel, and wherein the at least one pendulum winch further comprises at least one winch line attached for example via the work well of the vessel to the load support and/or to each of the pendulum devices. The means may alternatively, or in addition, comprise at least two hydraulic cylinders being arrangeable on the installation vessel, wherein the one end of at least one of the at least two hydraulic cylinders is moveably connected (directly or indirectly) to the first pendulum device and the one end of the remaining hydraulic cylinders is moveably connected (directly or indirectly) to the second pendulum device. The means may alternatively, or in addition, comprise at least one crane being arrangeable on the installation vessel, wherein the at least one crane comprises a crane line which in one end is attached (directly or indirectly) to the load support. The means may alternatively, or in addition, comprise means for controllable regulation of liquid and gas in the ballast system.

In another advantageous embodiment, the ballast system comprises at least one ballast tank, at least one liquid ballast connection suitable for controllable regulation of ballast liquid in the at least one ballast tank and at least one gas ballast connection suitable for controllable regulation of ballast gas in the at least one ballast tank. Note that the regulation may comprise both inlet and outlet. Preferably the liquid ballast connection is situated below the gas ballast connection. Further, the ballast system may be configured such that ballasting results in a symmetrical load distribution in the horizontal plane of the load supports, i.e. along the water surface, during use.

One or more embodiments of the invention also relate to an installation vessel comprising a load handling system according to any of the above-mentioned features for the load handling system and which is pivotably connected to the installation vessel, a work well and a lift device suitable for submerging and retrieval of load, comprising a lifting line which, during use, runs through the work well. By use of the invention the minimal opening through the work well can be smaller than the largest horizontal cross-section of the load, during use.

In an advantageous embodiment, the installation vessel further comprises at least one of a ballast pump and a high-pressure gas tank which is mountable in fluid communication with the ballast system on the load support by at least one ballast supply pipe going through, or alongside, at least one of the pendulum devices.

In another advantageous embodiment each of the first and the second pendulum device comprises a first pendulum arm and a second pendulum arm, wherein the first pendulum arm and the second pendulum arm is arranged parallel to each other, and wherein the end of the first pendulum arm and the end of the second pendulum arm are pivotably connected at the work well of the installation vessels on two diametrically opposite, or close to diametrically opposite, positions.

In another advantageous embodiment, the load handling system further comprises a lifting line comprising a first end which is connectable to the load with possibility for release and a second end which is attached to the lift device with possibility for release, wherein the at least one lifting line is guided below the installation vessel and through the work well.

In another advantageous embodiment, the pendulum system is attached in a lifting operation module arranged along the deck of the installation vessel, preferably displaceable.

One or more embodiments of the invention also relate to a method for submerging of load from the water surface to a position situated below a vessel, for example an installation vessel, by use of a load handling system according to any of the features given above, and wherein the vessel is equipped with a lift device comprising a lifting line. The method is characterized in comprising the following steps, in any sequence:

A. mounting the load handling system to the vessel,
B. placing the load on the submergible load support,
C. attaching one end of the lifting line preferably weight-symmetrical, to the load,
D. moving the vessel to a submerging area,
E. lowering the load support and the load in a pendulum movement to the second position situated below the vessel by operation of the mounted pendulum system, for example in or close to the vertical axis going through the centre of gravity of the vessel and/or below the work well of the vessel, F. releasing the load from the load support such that the load is hanging freely at the end of the lifting line and G. moving the load support away from the second position at a distance which allows for vertical submerging of the load to the underlying seabed.

In an advantageous embodiment step G further comprises filling of ballast fluid in the ballast system such that desired separation between the load support and the load is achieved.

In an advantageous embodiment step G further comprises holding tight the pendulum system by use of one or more suitable locking devices and lifting of the load by use of the lift device such that desired separation distance between the load support and the load is achieved.

One or more embodiments of the invention described above may provide one or more of the following advantages:

There is no need to build a vessel based on what the size of the work well will allow regarding size of load. Common size installation vessels may thereby be used if the buoyancy of the vessel is adequate for the lifting operation.

Handling of load from about centre of the buoyancy geometry on a vessel provides large advantages regarding the stability of the vessel during such a lifting operation.

Handling of load from about centre of the buoyancy geometry on a vessel provides large advantages regarding other types of weight balancing and safety on the vessel, for example, if one were to lift such loads by a crane situated on a side edge of the vessel.

Balance arm and corresponding counter weights by use of a traditional crane with horizontal outrigger is avoided.

Regulation and control during the lifting operation (more specific for example heave-compensation) becomes simpler due to an improved vessel stability on the surface in general.

The modifications on the vessels are comparatively modest in view of the utility value.

When the tow ballast tank is not mounted the vessels may operate as normal even if the modifications on the vessel have been performed.

Load support may be used on multiple other corresponding vessels.

During filling of the ballast tank(s) of the load supports and lowering of the load support, the pendulum arms will hold the load support at a safe distance from the installation vessel.

During filling of the ballast tank(s) of the load supports and lowering of the load support, the pendulum arms will hold the load support in a stable parallel position in relation to the deck on the installation vessel (and/or the water surface).

The load support will centre itself in a pendulum suspension below the vessel when the load support is guided to its lowest vertical level.

The load support will act in a stabilizing manner on the movements of the vessel when the load support hangs below the vessel and/or is on its way from a position on the water surface and down below the vessel.

The load support will seek to act as a downward directed pendulum weight and thereby contribute to that initial line establishment and lifting/lowering always occurs in an approximately vertical direction.

When the load support hangs below the vessel it is possible for the load to be released more safely from the load support and transferred to the lift device on board the vessel, since this operation occurs under water and with a controlled distance from the hull of the vessel and in an area not exposed to waves.

When the load support again is established in a surface position one may by regulating the ballasting in the ballast system of the load supports, be able to contribute positively to the buoyancy and stability of the vessel during the continued load handling.

The pendulum arms/pendulum device may be arranged such that the load support may have a breadth being less than, equal to or larger than the breadth of the vessel.

The load support may have a different design according to the geometry of the load object. Length and breadth are made according to the inventions purpose.

The pendulum arms/pendulum device may lock the load support in the upper position given by the placement of the fulcrums of the pendulum arms/pendulum devices. The downward pivotal movement of the pendulum arms/pendulum device may also be locked.

The load support and the pendulum arms/pendulum device may be placed in the harbor or on land when not in use. Modifications for new load may thus be made independently of the use of the vessel.

The load handling system according to one or more embodiments of the invention may be constructed for handling loads of more than 500 tons, for example between 500 tons and 2000 tons, which are typical weights of parts which are to constitute larger modules in subsea constructions, and which possibly will have to be replaced and maintained at regular intervals. However, the invention is not limited to these weight ranges.

In the following description many specific details are presented to provide a thorough understanding of the embodiments of the system, the vessel and the method. A skilled person within this technical field will however realize that these embodiments may be put into practice without one or more of the specific details, or with other components, systems, etc. In other cases, well known structures or operations are not shown, or not described in detail, to avoid making aspects of the described embodiments unclear.

BRIEF DESCRIPTION OF THE DRAWINGS

Embodiments of the present invention will now be described with reference to the appended drawings, wherein FIG. 1 show, in a perspective view, the principals for a vessel with a load handling system according to a first embodiment of the invention, FIG. 2 show in a perspective view the principals for a vessel with a load handling system according to a second embodiment of the invention, FIGS. 3A and 3B show, in a side view, an installation vessel with a load handling system according to the second embodiment of the invention comprising a load support in the shape of a barge supporting a load, wherein FIG. 3A shows the situation wherein the barge floats at the water surface and FIG. 3B shows the situation wherein the barge is guided in a pendulum movement towards a position situated below the installation vessel, FIG. 5B shows the situation wherein the barge is guided in a pendulum movement towards a position situated below the installation vessel, FIG. 5C shows the situation wherein the pendulum movement is completed and the barge with load is situated directly below the work well of the installation vessel, FIGS. 6A-C show, in a side view, detailed drawings of the pendulum arms of the load handling systems according to the second embodiment of the invention, wherein FIG. 6A shows the pendulum arms pivotably mounted on the load support and installation vessel in the situation wherein the load support floats in a water surface, and FIGS. 6B and 6C show the pendulum arms on FIG. 6A, with and without impact surfaces, respectively, FIGS. 10A and 10B show, in a side view, the fastening area for a pendulum arm on an installation vessel according to the invention and/or on a load support according to the invention, wherein FIG. 10A and FIG. 10B show the fastening area where the pendulum arm is mounted on and removed, respectively, FIGS. 11A and 11B show, in a side view, alternative embodiments of a load support according to the invention, wherein FIG. 11A and FIG. 11B show a load support in the shape of a barge and a load, wherein the load supporting surface of the barge is arranged vertically displaced from, and aligned with, the lowest position of the barge, FIGS. 13A-D show possible movements of a load handling system according to the invention as a consequence of for example external environmental forces such as wind, currents, etc, wherein FIGS. 13A-D show heave movement (vertically the water surface), tensional swing (along the longitudinal direction of the vessel), sway movement (parallel to the water surface and perpendicular to the longitudinal direction of the vessel) and yaw movement (rotation around the centre point of the load support between the pendulum arms, parallel to the water surface), respectively.

DETAILED DESCRIPTION OF THE INVENTION

Figure 1:
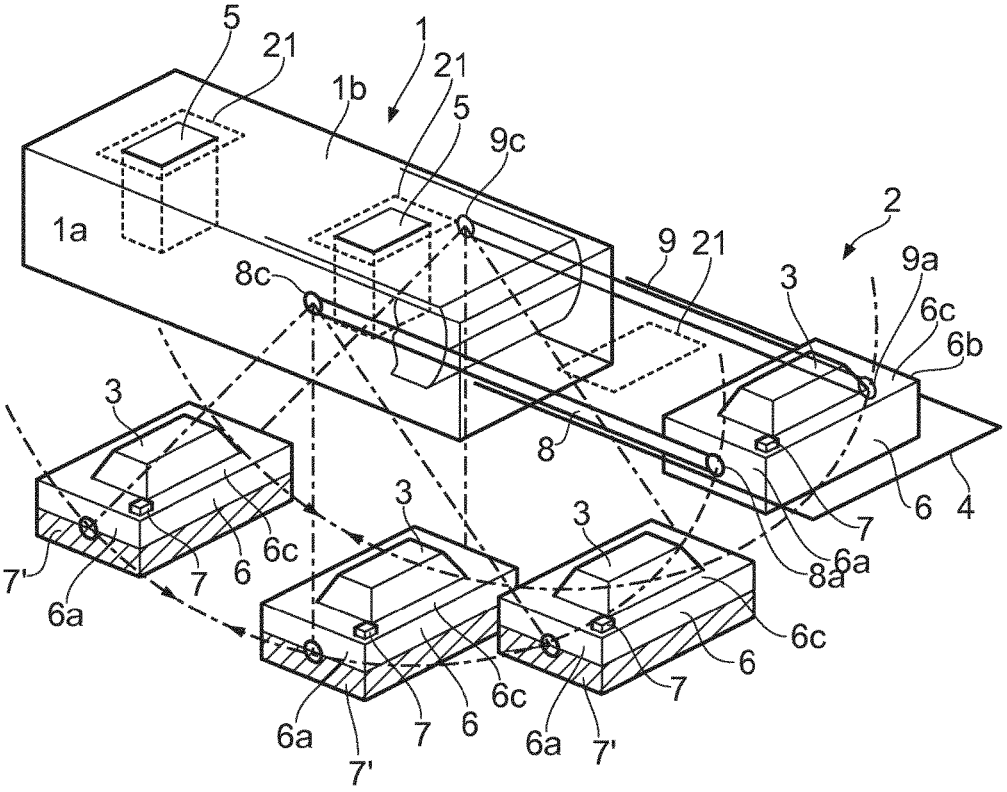

FIG. 1 shows the principals for one or more embodiments of the present invention, wherein a load support 6, which supports a load 3 on a support surface 6*c*, is pivotably mounted at a certain distance from an installation vessel 1 via two rigid/stiff pendulum devices 8,9 in the shape of pendulum arms or stays. The load support 6, the load 3 and the pendulum devices 8,9 together constitute a load handling system 2. One end 8*a*,9*a* of each pendulum arm 8,9 is pivotably mounted on two opposite peripheral surfaces 6*a*,6*b* of the load support 6. The second end 8*c*,9*c* is pivotably mounted on two opposite sides 1*a*,1*b* of the vessel. On the vessel 1 it is mounted means 11,11',24,25 (see FIGS. 3, 4, 5, 7 and 8) for activating said pendulum arms 8,9 such that these initiate a pendulum movement of the load support 6 between a position being planar to the water surface 4 to a position below the installation vessel 1, preferably to a position straight below the work well/moonpool 5 of the vessel 1, optionally one of multiple work wells 5,5' of the vessel. As indicated by a dotted line around the work well(s) 5,5', the largest base area of the load 3, i.e. the largest area oriented in parallel to the deck 19 of the vessel 1, is larger than the base area(s) 21 of the work well(s). Further, the load support 6 comprises a ballast system 7 which makes it possible to control the amount of ballast water 7' inside the load support 6.

Figure 2:
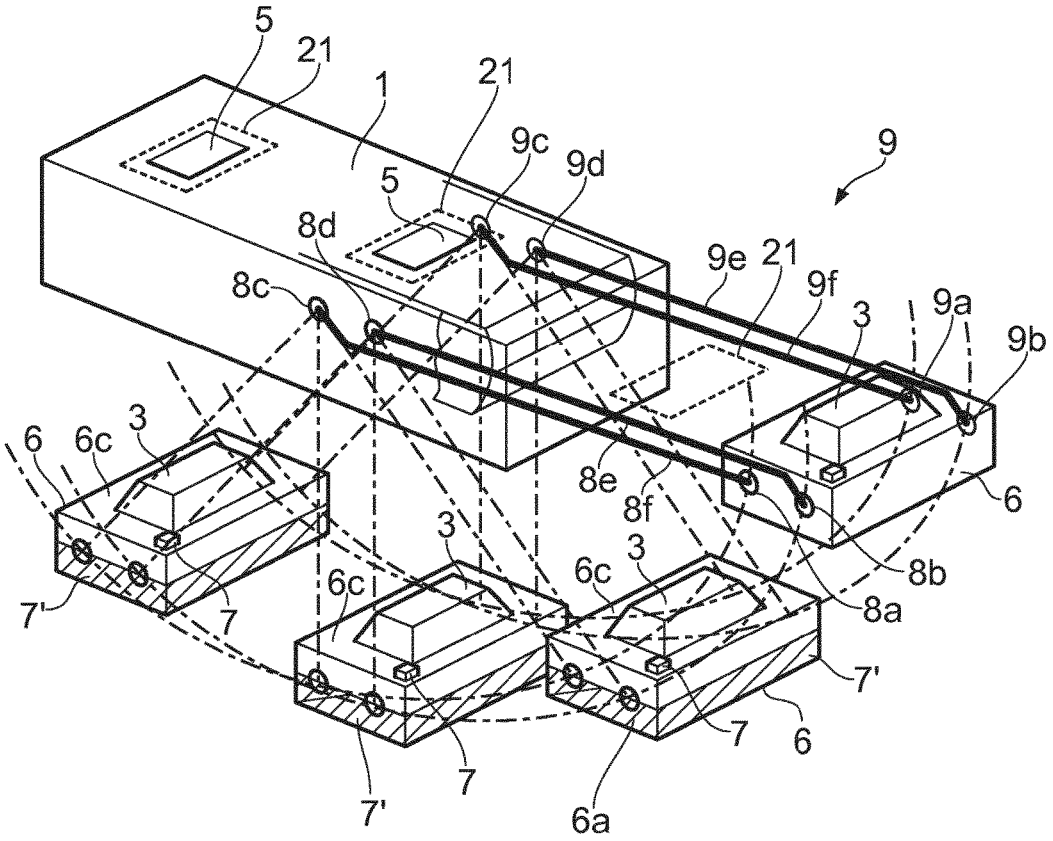

In FIG. 2 a principle drawing is illustrated as in FIG. 1, showing a second embodiment according to the invention, wherein two parallel pendulum arms 8*e*,8*f* constitute the first rigid pendulum device 8 and two parallel pendulum arms 9*e*,9*f* constitute the second rigid pendulum device 9. The two parallel pendulum arms 8*e*,8*f*,9*e*,9*f* are, for each pendulum device 8,9, pivotably mounted in one end 8*a*,8*b*,9*a*,9*b* to the opposite side surfaces 6*a*,6*b* of the load support 6, and pivotably mounted in the other end 8*c*,8*d*,9*c*,9*d* to the opposite side surfaces 1*a*,1*b* of the vessel 1.

Figure 3:
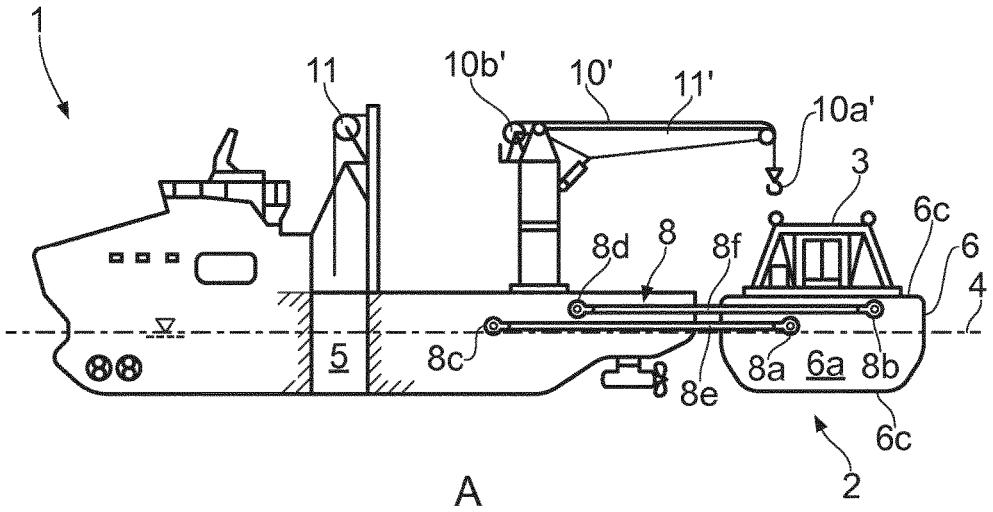
Figure 3:
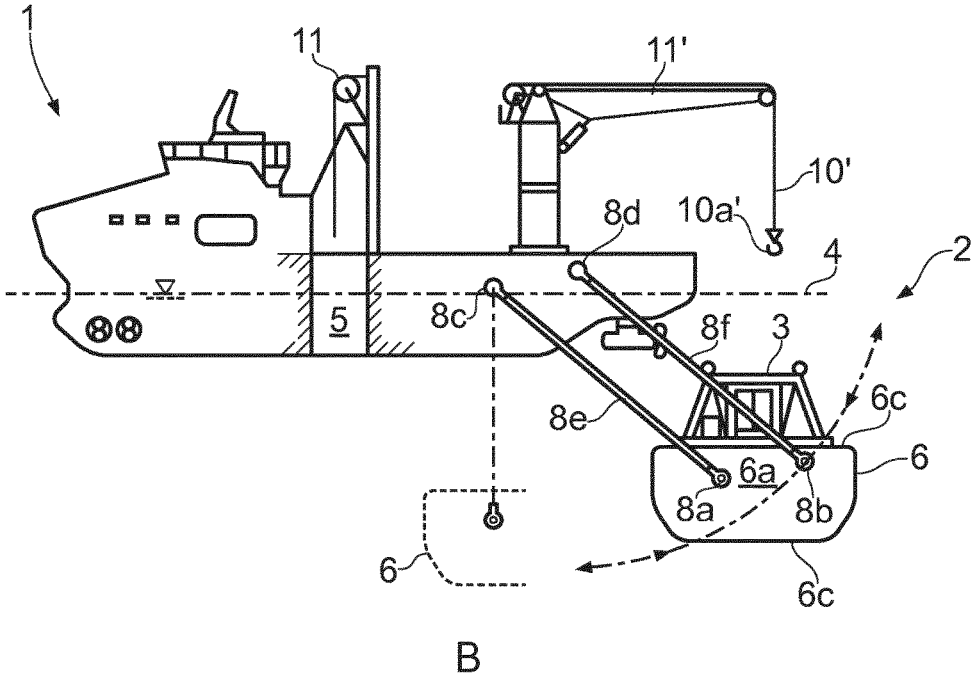

An example of installing a load handling system 2 according to the embodiment described for FIG. 2 is shown in FIG. 3. As in FIG. 2, it is shown an installation vessel 1 comprising a work well 5 and a load handling system 2 comprising a load support 6 in the shape of a barge 6, a load 3 which rests on a load carrying surface 6*c* and two pendulum arms 8*e*,8*f*,9*e*,9*f* arranged on each side 1*a*,1*b*,6*a*,6*b* of the vessel and the barge in the longitudinal direction of the vessel. Also, FIG. 3 shows two different lift devices in the shape of a winch device 11 and a crane 11'. A dedicated lifting line 10' for the crane 11' is shown, and which in one end is attached to a hook 10*a*' suitable for coupling to the load 3 and attached to the crane 11' in the other end. FIGS. 3A and 3B show respectively the situation wherein the barge 6 floats at the water surface 4, and wherein the barge 6 is guided in a pendulum movement towards a position situated below the installation vessel 1. The pendulum movement is initiated by the above-mentioned means 11,11',24,25 and/or by use of the ballast system 7.

Figure 4:
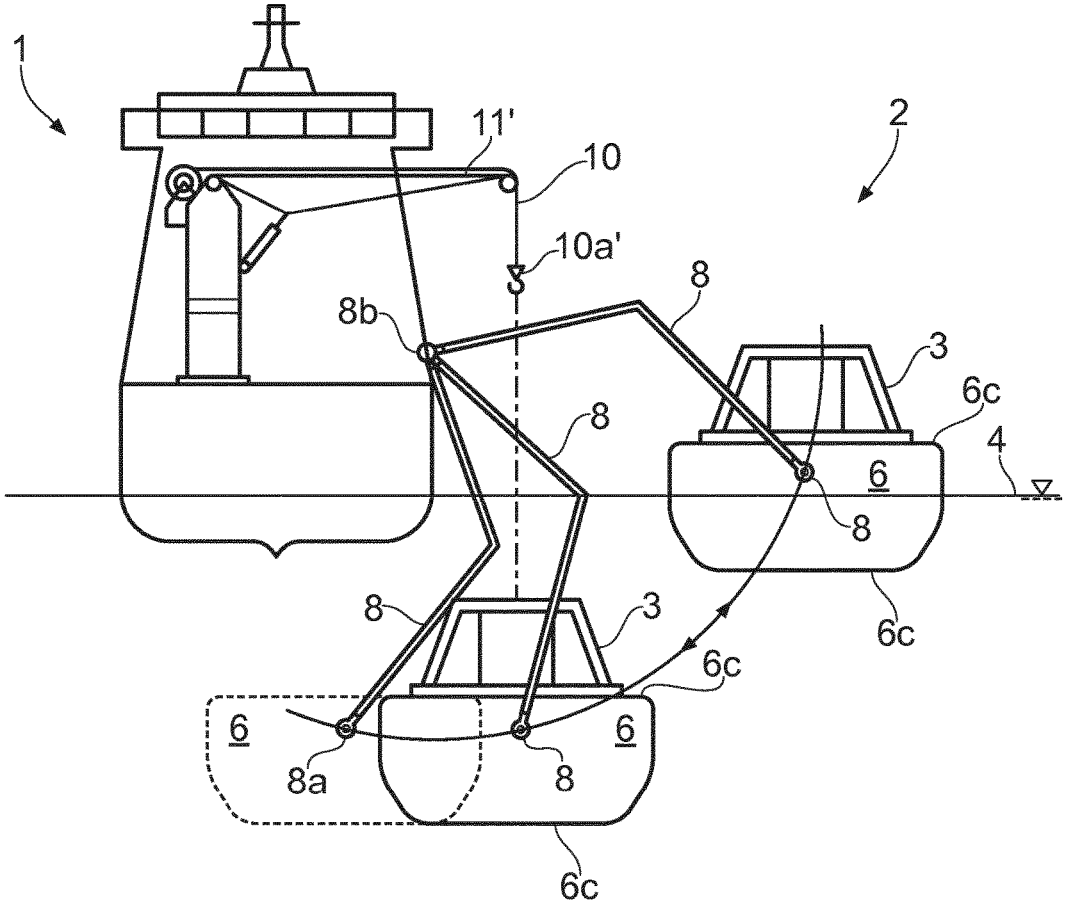
FIG. 4 shows, in a side view, an installation vessel with a load handling system according to a third embodiment of the invention comprising a load support in the shape of a barge supporting a load, wherein the pendulum arms of the load handling systems are pivotably mounted on a side of the installation vessel.

A third embodiment according to the invention is shown in FIG. 4. As for FIG. 1-3, FIG. 4 shows an installation vessel 1 comprising a work well 5 and a load handling system 2 comprising a load support 6 in the shape of a barge 6, a load 3 which rests on a load carrying surface 6*c* and pendulum devices 8,9. However, the other end of the pendulum devices 8,9 is arranged on one side 1*b* of the installation vessel 1. For allowing the barge 6 to be guided in below the vessel 1, the pendulum devices/pendulum arms 8,9 are angled.

Figure 5:
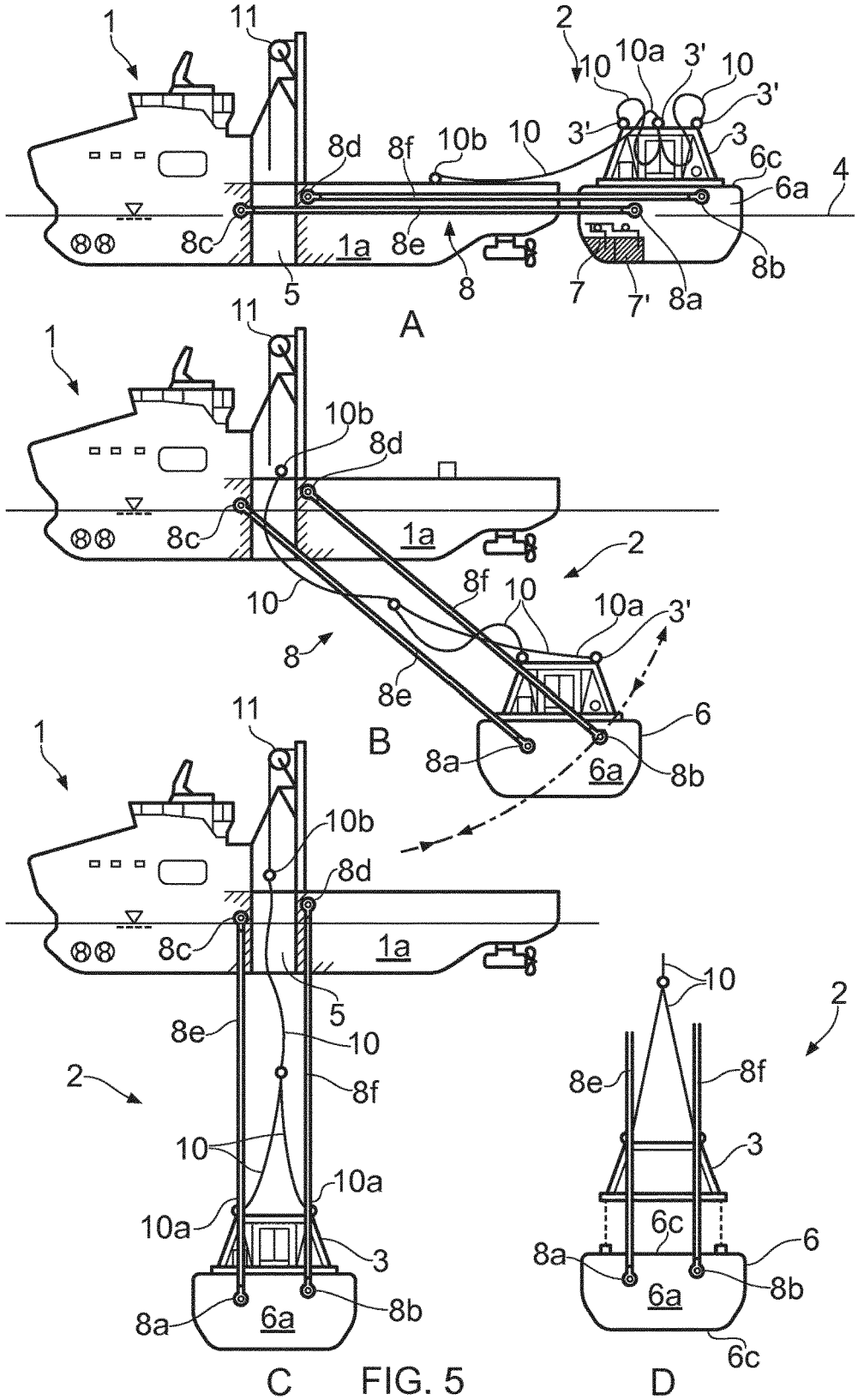
FIGS. 5A-C show, in a side view, an installation vessel with a load handling system as in FIG. 2, wherein the pendulum arms of the load handling systems are pivotably mounted around a work well/moonpool of the installation vessel, in that FIG. 5A shows the situation wherein the load support in the shape of a barge floats in the water surface.
FIG. 5D shows, in a side view, a load support and an appurtenant load according to the second embodiment of the invention, wherein the load support and the load are vertically displaced relative to each other.

FIG. 5A-C shows, in a side view, an installation vessel with a load handling system as in FIG. 2, i.e. with two parallel pendulum arms 8*e*,8*f*,9*e*,9*f* on each side of the vessel 1 and the barge 6, relative to the longitudinal direction of the vessel 6. In addition, FIG. 5 shows a lift device 11 situated directly above the work well of the vessel 1 and a lifting line 10 having multiple ends 10*a* connected to respective fastening positions 3' on the load 3. A ballast system 7 with ballast water 7' divided into separate rooms is shown in the barge 6. Contrary to the embodiment shown in FIG. 3, the pendulum arms 8*e*,8*f* of the load handling system 2 are pivotably mounted around the work well/moonpool 5 of the vessel 1 at their respective ends 8*c*,8*d*. FIG. 5 A shows the situation wherein the barge 6 floats at the water surface 4. FIG. 5B shows the situation wherein the barge 6 is moved about halfway in a pendulum movement towards a position situated under the work well 5, and FIG. 5 C shows the situation wherein the pendulum movement is completed and the barge 6 with load 3 finds itself directly below the work well 5. FIG. 5D shows, in a side view, a barge 6 and an appurtenant load 3, wherein the barge 6 and the load 3 are vertically displaced relative to each other, for example by hooking the second end 10*b* of the lifting line 10 to the lift device 11 and lifting the load 3 and/or regulating the amount of ballast water 7' by help of the ballast system 7, such that the barge obtains a larger negative buoyancy.

Figure 6:
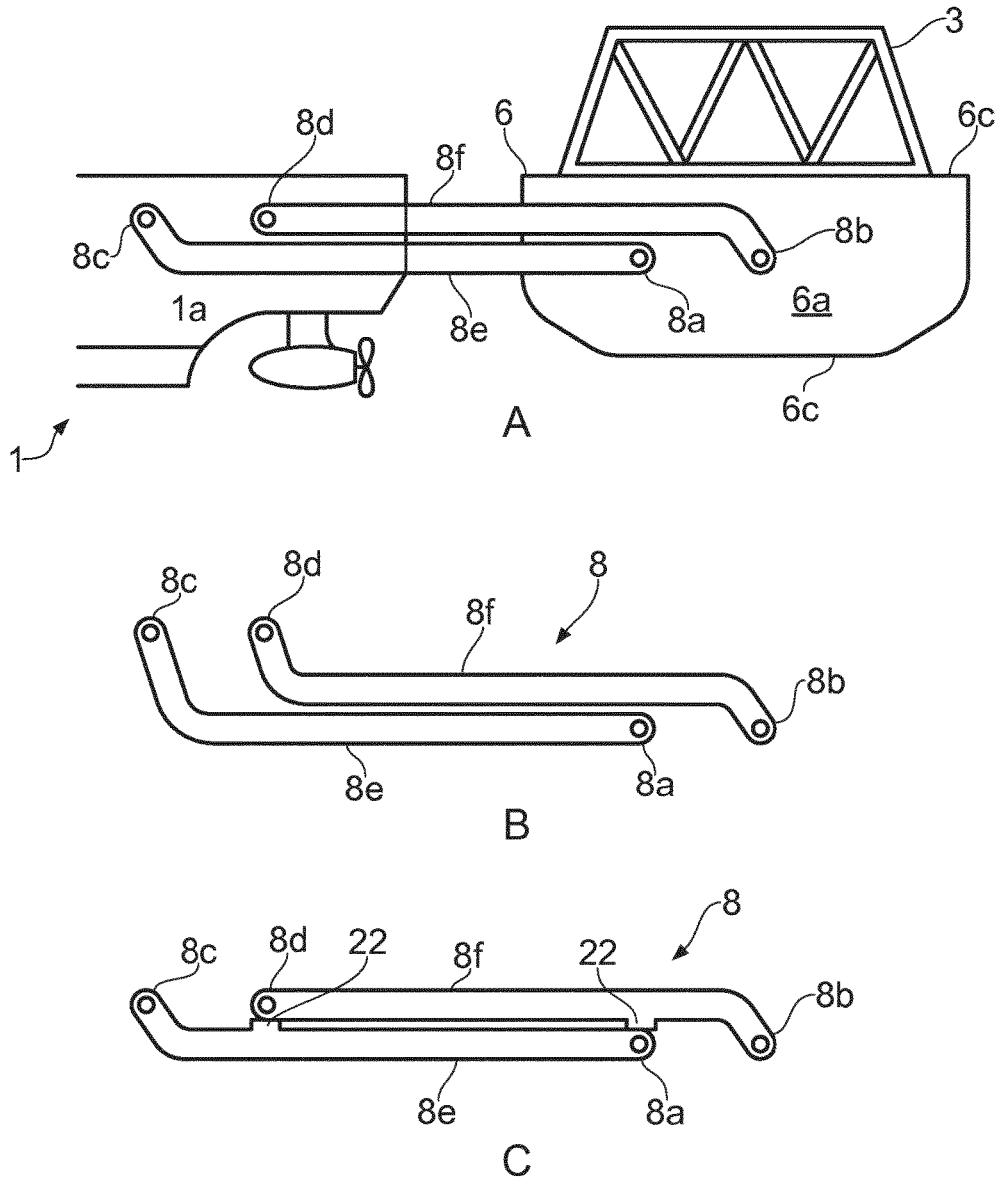

FIG. 6 shows the pendulum arms 8*e*,8*f* of the load handling systems 2 according to the second embodiment of the invention. As mentioned above, the pendulum arms 8*e*,8*f* are pivotably mounted on the load support/the barge 6 and installation vessel 1 in their respective ends 8*a*,8*b*,8*c*,8*d*. This is shown in FIG. 6A. FIGS. 6B and C shows the pendulum arms 8*e*,8*f* on FIG. 6A, with and without impact surfaces, respectively 22.

Figure 7:
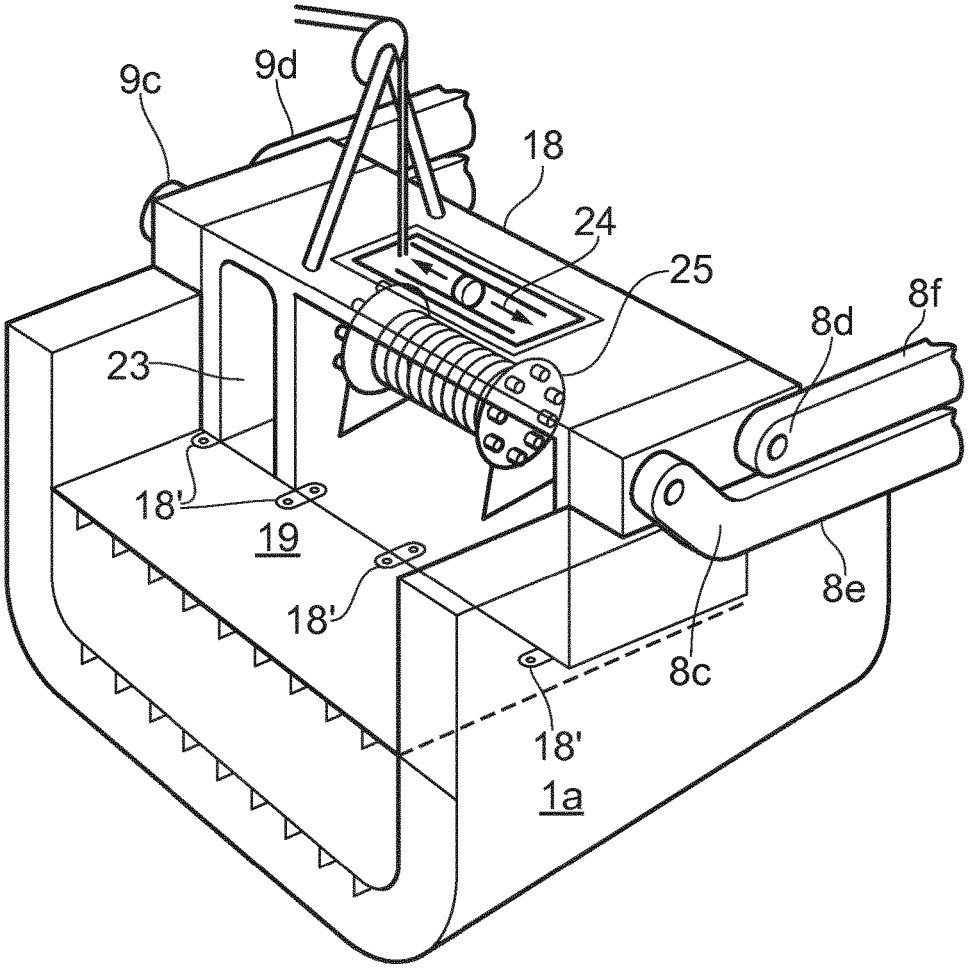
FIG. 7 shows, in a perspective view, further details around the fastening of the pendulum arms to a lifting operation module according to the invention, wherein the lifting operation module is mounted on the deck of the installation vessels, and wherein a lifting winch for activation of the load handling system is arranged inside a lifting operation module housing, FIG. 8 show, in a perspective view, another embodiment of the lifting operation module shown in FIG. 7, wherein the lifting operation module is displaceable i the longitudinal direction of the installation vessels.
Figure 8:
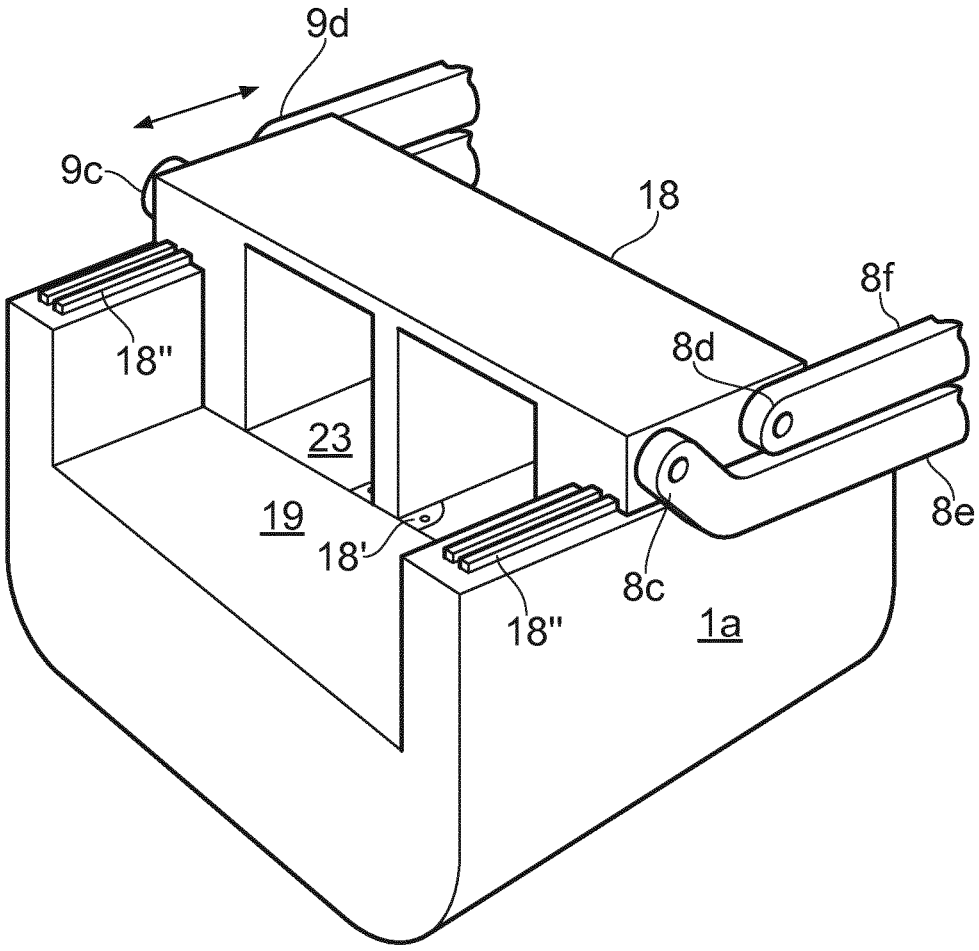

The pendulum arms 8,9,8*e*,8*f*,9*e*,9*f* may for example be pivotably mounted on a dedicated lifting operation module 18 as shown in FIGS. 7 and 8. FIG. 7 shows such a lifting operation module 18 mounted on the deck 19 of the installation vessel 1, wherein a lifting winch 25 is placed inside a lifting operation module housing, and contributes to activate/start the pendulum movement for the load handling system 2. The winch line for the lifting winch 25 is guided through a spooling gear 24 which allows even winding around the drum of the lifting winch 25. The lifting operation module 18 is further equipped with fastening devices 18' and possibility for access/passage 23 to/from the quarterdeck of the vessel 1. On FIG. 8, the lifting operation module 18 is arranged on dedicated rails 18" which makes it possible to move the lifting operation module 18 along the deck 19 in the longitudinal direction of the vessel 1.

Figure 9:
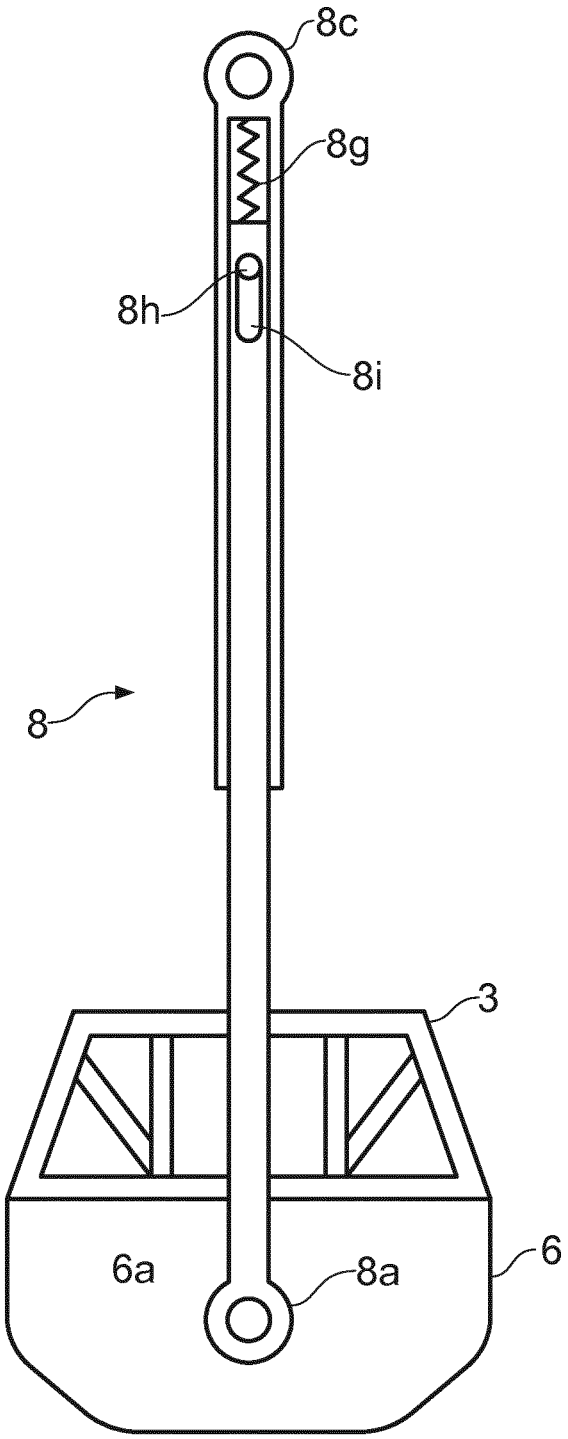
FIG. 9 shows in a side view a telescopic pendulum arm according to the invention mounted on a load support in the shape of a barge supporting a load, wherein the telescopic pendulum arm is equipped with a resilient dampening device.

The pendulum devices/pendulum arms 8,9 may advantageously be equipped with a dampening device in the longitudinal direction. FIG. 9 shows a telescopic pendulum arm 8 with a barge 6 and load 3. Inside the telescopic pendulum arm 8, a spring device 8*g* is mounted which in one end is connected to the end of the outer part of the telescopic pendulum arm 8 and the other end to a holding pin 8*h* situated at the end of the inner part of the telescopic pendulum arm 8. The holding pin 8*h* is guided by a restriction groove 8*i* which restricts the degree of length variation during damping. With such a dampening arrangement 8*g*-*i*, the forces in the load handling system 2 are substantially reduced during operation.

Figure 10:
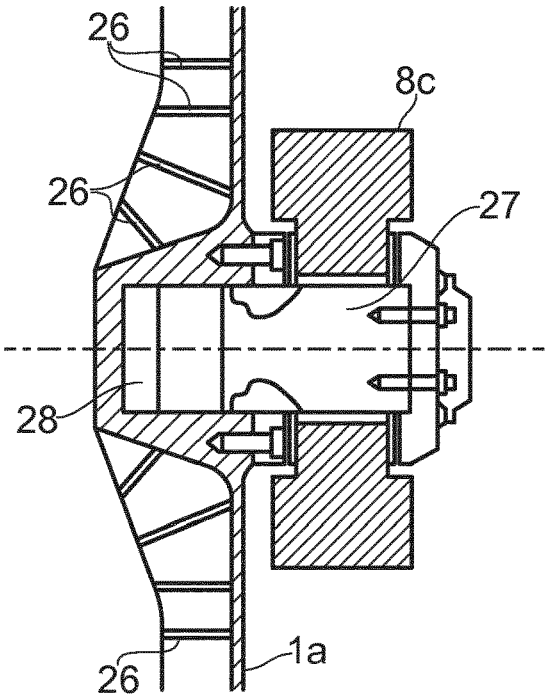
Figure 10:
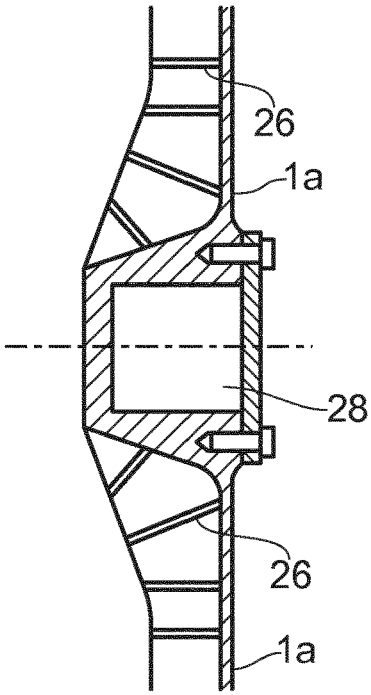

Details around the fastening area for the pendulum arms on the hull of the installation vessel 2 and/or the side surfaces 6*a*,6*b* of the load support 6 are illustrated on FIGS. 10A and B. Due to the significant forces during a pendulum operation, the hull of the vessel 1 and/or the sides 6*a*,6*b* of the load support 6 are preferably enforced with hull enforcements 26 around the fastening area. On FIG. 10A, the ends 8*c* of the pendulum arms are shown mounted on a rotary pin 27 inserted in a dedicated recess 28. FIG. 10B shows the fastening area when the pendulum arm 8*c* is removed.

Figure 11:
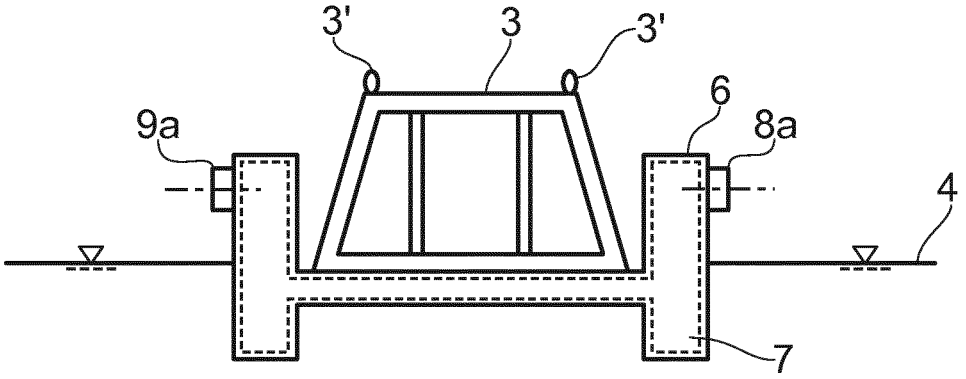
Figure 11:
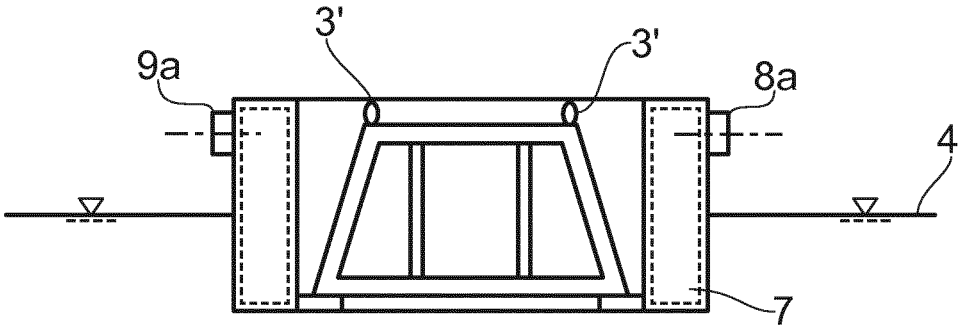
Figure 12:
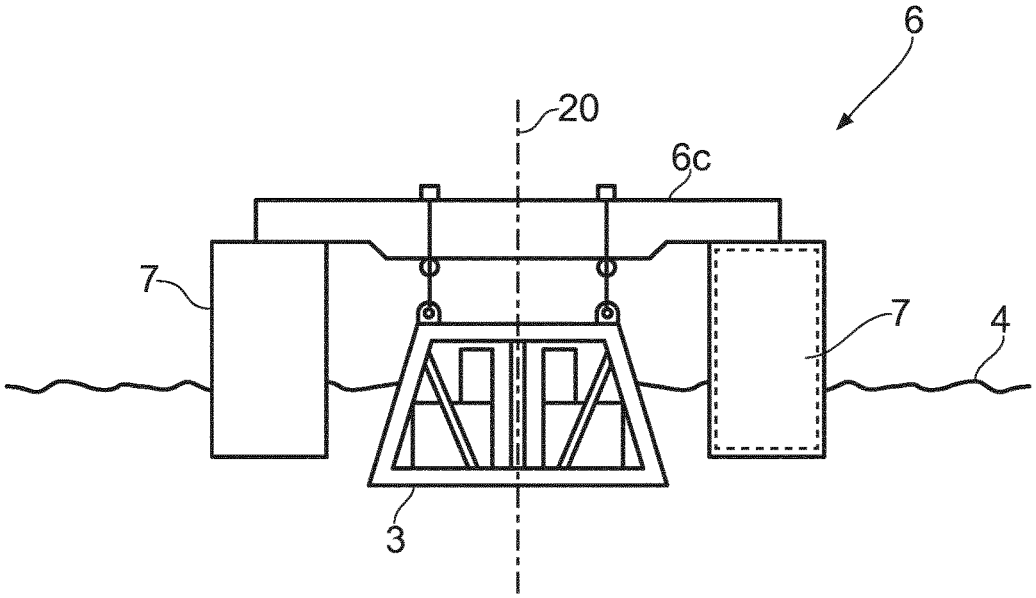
FIG. 12 shows, in a side view, yet an alternative embodiment of a load support according to the invention, wherein the load hangs below the transverse part of the load support

Alternative embodiments of a load support/barge 6 are shown in FIGS. 11A and B, wherein FIG. 11A and FIG. 11B show a barge 6 with a load 3, and wherein the load supporting surface of the barge 6*c* is arranged vertically displaced from, and aligned with, the lowest position of the barge 6. Yet an alternative embodiment of a load support 6 is shown in FIG. 12. Here, the load 3 is suspended below the transverse part of the load support 6.

Figure 13:
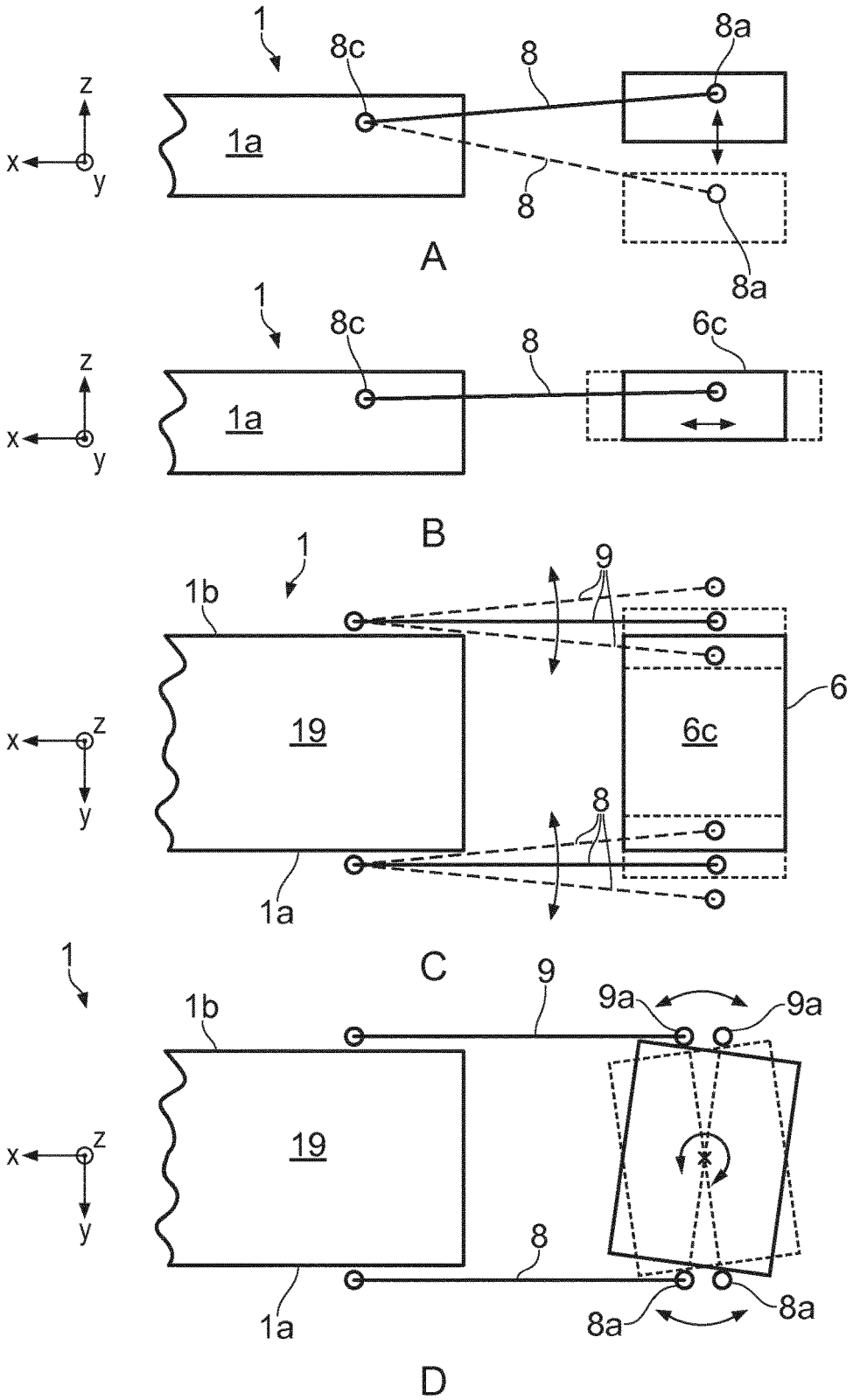

FIG. 13 shows possible movements of a load handling system 2 as a consequence of for example external environmental forces, such as wind, currents, etc. FIG. 13 A-D shows heave movement (movement vertically to the water surface 4), tensional swing (movement along the longitudinal direction of the vessel 1), sway movement (movement parallel to the water surface 4 and perpendicular to the longitudinal direction of the vessel 1) and yaw movement (rotation around the centre point of the load support/barge 6 between the pendulum arms 8,9, parallel to the water surface 4), respectively.

In the preceding description, different aspects of the system according to one or more embodiments of the invention have been described with reference to the illustrative embodiments. With the purpose of providing a thorough understanding of the system and its operation, explanations, specific numbers, systems and configurations were disclosed. However, this description is not intended to be interpreted in a limiting manner. Different modifications and variations of the illustrative embodiment, as well as other embodiments of the system, which will be obvious to the skilled person within the technical field relating to the disclosed content, shall be within the scope of the present invention.

REFERENCE NUMBERS

1 Vessel/installation vessel
1*a* First side of the vessel
1*b* Second side of the vessel
2 Load handling system
3 Load/seabed construction modul
3' Fastening position on load
4 Water surface
5 Work well/Moonpool
5' Second work well
6 Load support/barge/submergible barge
6*a* First peripheral surface of load support/barge
6*b* Second peripheral surface of load support/barge
6*c* Peripheral surface of load support/barge parallel with water surface, load supporting surface
7 Ballast system
7' Ballast water
8 First rigid pendulum device
8*a* First end of first pendulum arm (first rigid pendulum device)
8*b* First end of second pendulum arm (first rigid pendulum device)

8*c* Second end of first pendulum arm (first rigid pendulum device)
8*d* Second end of second pendulum arm (first rigid pendulum device)
8*e* First pendulum arm (first rigid pendulum device)
8*f* Andre pendulum arm (first rigid pendulum device)
8*g* Fjeranordning with støtdempning i pendulum arm
8*h* Holdetapp
8*i* Begrensningsspor
9 Second rigid pendulum device
9*a* First end of first pendulum arm (second rigid pendulum device)
9*b* First end of second pendulum arm (second rigid pendulum device)
9*c* Second end of first pendulum arm (second rigid pendulum device)
9*d* Second end of second pendulum arm (second rigid pendulum device)
10 Lifting line/load line winch
10' Lifting line/load line crane
10*a* First end of lifting line (for fastening to load)—winch
10*a'* First end of lifting line (for fastening to load)—crane
10*b* Second end of lifting line (for fastening to lift device)—winch
10*b'* Second end of lifting line (for fastening to lift device)—crane
11 Lift device (on vessel) winch
11' Lift device (on vessel) crane
17 Recess (for pendulum system)
18 Lifting operation module
18' Fastening device for lifting operation module
18" Rails for movement of lifting operation module
19 Deck (on vessel)
20 Centered vertical plane through load support
21 Cross-sectional area of load, projected onto the deck of the vessel
22 Dedicated impact surface between the pendulum arms
23 Access/passage to/from quarterdeck
24 Spooling gear
25 Lifting winch (for load support/barge)
26 Hull reinforcement
27 Rotary pin, preferably demountable
28 Recess (for rotary pin)

The invention claimed is:

1. A load handling system for submerging of load from a water surface to a position situated under a connected installation vessel, the load handling system comprises:

a submergible load support for support of the load to be submerged, which submergible load support comprises a ballast system, wherein the load handling system further comprises a controllable pendulum system comprising:

a first rigid pendulum device which comprises:

a first end which is pivotably connected to the submergible load support; and a second end which is connectable to the installation vessel in a first pivot joint during use, and a second rigid pendulum device, oriented parallel to the first pendulum device, which comprises:

a first end which is pivotably connected to the submergible load support; and a second end which is connectable to the installation vessel in a second pivot joint during use, the first end of the first rigid pendulum device and the first end of the second rigid pendulum device are situated symmetrical, or close to symmetrical, around a centered vertical plane through the load support in a direction parallel to the pendulum devices and in that the sizes and connecting positions of the pendulum system allows for controllable pendulum movement of the load support between a first position situated at the water surface at the installation vessel and a second position situated below the installation vessel, when the load handling system is pivotably connected to the vessel, and wherein the load handling system further is configured such that an initial orientation of peripheral surfaces of the load support, relative to the water surface, is kept constant, or close to constant, at least during said pendulum movement.

2. The load handling system according to claim 1, wherein the second position is situated on or close to a vertical axis going through the centre of gravity of the installation vessel.

3. The load handling system according to claim 1, wherein the second position is situated below a work well of the installation vessel.

4. The load handling system according to claim 1, wherein the load support comprises a barge for support of loads.

5. The load handling system according to claim 1, wherein each of the pendulum devices comprises a dampening device for dampening of forces established as a consequence of relative movement between the installation vessel and the load support.

6. The load handling system according to claim 1, wherein each of the pendulum devices comprises a pendulum arm having a telescopic shape, wherein the telescopic shape allows for controllable regulation of a length of the pendulum arms.

7. The load handling system according to claim 1, wherein the first end of the first pendulum device and the first end of the second pendulum device are pivotably connected to a first peripheral surface and a second peripheral surface of the load support, respectively.

8. The load handling system according to claim 1, wherein, during use, the second end of the first rigid pendulum device and the second end of the second rigid pendulum device are situated symmetrical, or close to symmetrical, around a centered vertical plane through the installation vessel in a direction parallel to the pendulum devices.

9. The load handling system according to claim 1, wherein each of the first and the second pendulum device comprises a first pendulum arm and a second pendulum arm arranged in parallel.

10. The load handling system according to claim 1, wherein the system further comprises a lifting line comprising:

a first end which is connectable to the load with possibility for release; and a second end which is connectable to a lift device arranged on the installation vessel with possibility for release, and wherein the length of the lifting line is longer than a minimum distance from one or more fastening positions on the load, through a work well connected to the installation vessel, and to the lift device.

11. The load handling system according to claim 1, wherein the load handling system further comprises means for providing pendulum movement in that the means for providing the pendulum movement activates the pendulum system such that the load support moves between the first position at the water surface at the installation vessel and the second position below the installation vessel.

12. The load handling system according to claim 11, wherein the means comprises at least one of:

at least one pendulum winch being arrangeable on the installation vessel, wherein the at least one pendulum winch comprises at least one winch line fastened to at least one of the load support and to each of the pendulum devices;

at least two hydraulic cylinders being arrangeable on the installation vessel, wherein the one end of at least one of the at least two hydraulic cylinders is moveably connected to the first pendulum device and the one end of the remaining hydraulic cylinders is moveably connected to the second pendulum device;

at least one crane being arrangeable on the installation vessel, wherein the at least one crane comprises a crane line which in one end is attached to the load support; and a controllable regulator of liquid and gas in the ballast system.

13. The load handling system according to claim 1, wherein the ballast system comprises:

at least one ballast tank;

at least one liquid ballast connection for controllable regulation of ballast liquid in the at least one ballast tank; and at least one gas ballast connection for controllable regulation of ballast-gas in the at least one ballast tank.

14. An installation vessel for submerging of loads to the seabed, wherein the installation vessel comprises:

a load handling system according claim 1 and which is pivotably connected to the installation vessel;

a work well; and a lift device for submerging and retrieval of load comprising a lifting line which, during use, runs through the work well.

15. The installation vessel according to claim 14, wherein the installation vessel further comprises at least one of:

a ballast pump; and a high-pressure gas tank, which is mountable in fluid communication with the ballast system on the load support by at least one ballast supply pipe going through or along at least one of the pendulum devices.

16. The installation vessel according to claim 14, wherein each of the first and the second pendulum device comprises:

a first pendulum arm; and a second pendulum arm, wherein the first pendulum arm and the second pendulum arm are arranged parallel to each other, and wherein the end of the first pendulum arms and the end of the second pendulum arms are pivotably connected at the work well of the installation vessel on two diametrically opposite, or close to diametrically opposite, positions.

17. The installation vessel according to claim 14, wherein the load handling system further comprises a lifting line comprising:

a first end which is connectable to the load with possibility for release; and a second end which is attached to the lift device with possibility for release, wherein the at least one the lifting line is guided below the installation vessel and through the work well.

18. The installation vessel according to claim 14, wherein the pendulum system is attached to a lifting operation module arranged displaceable in a longitudinal direction on the deck of the installation vessel.

19. A method for submerging of load from a water surface to a position situated below a vessel by use of a load handling system according to claim 1, and wherein the vessel is equipped with a lift device comprising a lifting line, wherein the method comprises the following steps in any sequence:

A. mounting the load handling system to the vessel,

B. placing the load on the submergible load support,

C. attaching one end of the lifting line to the load,

D. moving the vessel to a submerging area,

E. lowering the load support and the load in a pendulum movement to the second position situated below the vessel by operation of the mounted pendulum system, F. releasing the load from the load support such that the load is hanging freely in the end of the lifting line and G. moving the load support away from the second position at a distance which allows for vertical submerging of the load to the underlying seabed.

20. The method according to claim 19, wherein step G further comprises filling ballast fluid into the ballast system such that a desired separation between the load support and the load is achieved.

21. The method according to claim 19, wherein step G further comprises:

holding the pendulum system still by use of one or more locking devices; and lifting of the load by use of the lift device such that a desired separation distance between the load support and the load is achieved.

* * * * *